US005580276A

United States Patent [19]

Mussen

[11] Patent Number: 5,580,276

[45] Date of Patent: Dec. 3, 1996

[54] COAXIAL PLUG CONNECTOR COMPONENT FOR CONNECTION TO A PRINTED CIRCUIT BOARD

[75] Inventor: Michel Mussen, Gent, Belgium

[73] Assignee: Siemens Aktiengesellschaft, Munich, Germany

[21] Appl. No.: 30,420

[22] PCT Filed: Sep. 4, 1991

[86] PCT No.: PCT/DE91/00698

§ 371 Date: Mar. 22, 1993

§ 102(e) Date: Mar. 22, 1993

[87] PCT Pub. No.: WO92/05606

PCT Pub. Date: Apr. 2, 1992

[30] Foreign Application Priority Data

Sep. 24, 1990 [DE] Germany ..... 40 30 210.5

[51] Int. Cl.[6] ..... H01R 9/07

[52] U.S. Cl. ..... 439/581; 439/63

[58] Field of Search ..... 439/578–585, 439/63, 675, 668, 669

[56] References Cited

U.S. PATENT DOCUMENTS

| | | | |
|---|---|---|---|
| 4,412,717 | 11/1983 | Monroe | 439/581 |
| 4,588,241 | 5/1986 | Ardezzone | 339/59 |
| 4,718,854 | 1/1988 | Capp et al. | 439/581 |
| 4,795,352 | 1/1989 | Capp et al. | 439/63 |
| 5,145,408 | 9/1992 | Houttenman et al. | 439/581 |

FOREIGN PATENT DOCUMENTS

| | | |
|---|---|---|
| 612478 | 11/1989 | Australia . |
| 0137370 | 4/1985 | European Pat. Off. . |
| 0341535 | 11/1989 | European Pat. Off. . |
| 0405334 | 1/1991 | European Pat. Off. . |

*Primary Examiner*—David L. Pirlot
*Attorney, Agent, or Firm*—Hill, Steadman & Simpson

[57] ABSTRACT

The coaxial plug connector element has a central push-in pin (5) and at least two peripheral push-in pins (7) for making a non-soldered contact between the inner conductor (1) and the outer conductor (2), respectively, and a printed circuit beard (8). An additional shielding sleeve (10) whose inner edge overlaps the outer conductor (2) is arranged on the peripheral push-in pins (7) such that it can move axially. When the plug connector component is pushed into the holes in the printed circuit board, the shielding sleeve is moved as needed and, regardless of the depth of insertion and the tolerances, provides a good contact with the printed circuit board and the outer conductor (2), ensuring that the plug connection provides reliable radio frequency shielding.

7 Claims, 2 Drawing Sheets

COAXIAL PLUG CONNECTOR COMPONENT FOR CONNECTION TO A PRINTED CIRCUIT BOARD

FIELD OF THE INVENTION

The invention relates to a coaxial plug connector component for connection to a printed circuit board, and particularly to a connector having a central connecting pin which is connected to an inner conductor and at least two peripheral connecting pins which are connected to a hollow-cylindrical outer conductor in each case being provided with a push-in zone for attachment in a respective hole in the printed circuit board.

DESCRIPTION OF THE RELATED ART

A plug connector component of this type having push-in pins is disclosed in German utility model 89 07 785. The push-in pins make it possible to produce a non-soldered connection between the coaxial plug connector and printed circuit board wiring. However, the problem exists that a gap in the radio-frequency shielding occurs in the region between the peripheral connecting pins. As a result of the tolerance during pushing into the printed circuit board, the gap cannot be completely closed by corresponding lengthening of the hollow-cylindrical outer conductor.

SUMMARY OF THE INVENTION

An object of the invention is therefore to provide a coaxial plug connector of the type mentioned initially such that reliable radio-frequency blocking is achieved even in the region of the push-in pins on the printed circuit board.

This and other objects are achieved according to the invention in that a shielding sleeve is held on the peripheral connecting pins, in the region between the push-in zones of the connecting pins and the outer conductor, such that the sleeve can move in the axial direction, the inwardly pointing edge of which shielding sleeve overlapping the outer conductor coaxially.

As a result of the moveable shielding sleeve, once the connecting pins have been pushed into the holes of the printed circuit beard without being soldered, r.f.-proof shielding for the inner conductor is achieved by the present invention in every case and independently of the magnitude of the tolerances. The shielding sleeve expediently has longitudinal grooves in its circumference which are parallel to the axis and in which the peripheral connecting pins are guided such that the connecting pins along the grooves relative to the sleeve with a push fit. As mentioned, at least two peripheral connecting pins are provided for symmetry reasons, on which the shielding sleeve can be guided via two corresponding longitudinal grooves. Three or even more such connecting pins can, of course, be provided, with a corresponding number of grooves being provided in the shielding sleeve.

In one expedient embodiment, the shielding sleeve has a first section with a greater wall thickness in order to form a larger end contact surface on the printed circuit board for the purpose of r.f.-proof shielding, and a second section with a smaller wall thickness in order to make overlapping contact with the outer conductor. This second section can be split at least over a part of its axial length into a plurality of resilient tabs for making contact with the outer conductor. In principle, it is possible to design the second section of the shielding sleeve such that it is plugged over the outside of the outer conductor. However, in a preferred embodiment, this second section has a reduced diameter so that it projects into an annular cavity between the outer conductor and the inner conductor, or the insulation surrounding the inner conductor. In order to complete the r.f.-blocking, the end surface of the shielding sleeve points toward the printed circuit board and is additionally expediently provided with coaxial ridges. These ridges provide a reliable contact with the printed circuit board surface and hence ensure radio-frequency blocking.

BRIEF DESCRIPTION OF THE DRAWINGS

The invention is explained in more detail in the following text using an exemplary embodiment and the drawing, in which.

DETAILED DESCRIPTION OF THE PREFERRED EMBODIMENTS

Figure 2:
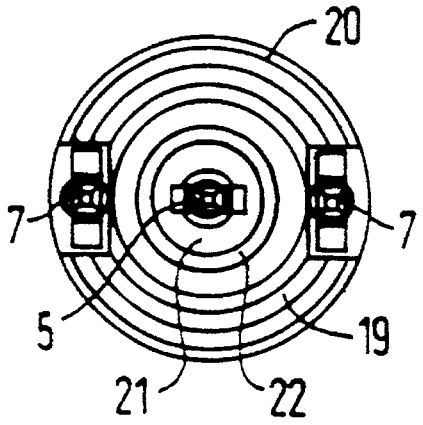
FIG. 2 shows a bottom view of the plug connector component of FIG. 1, seen in the direction II from the connecting pins without the circuit board.
Figure 1:
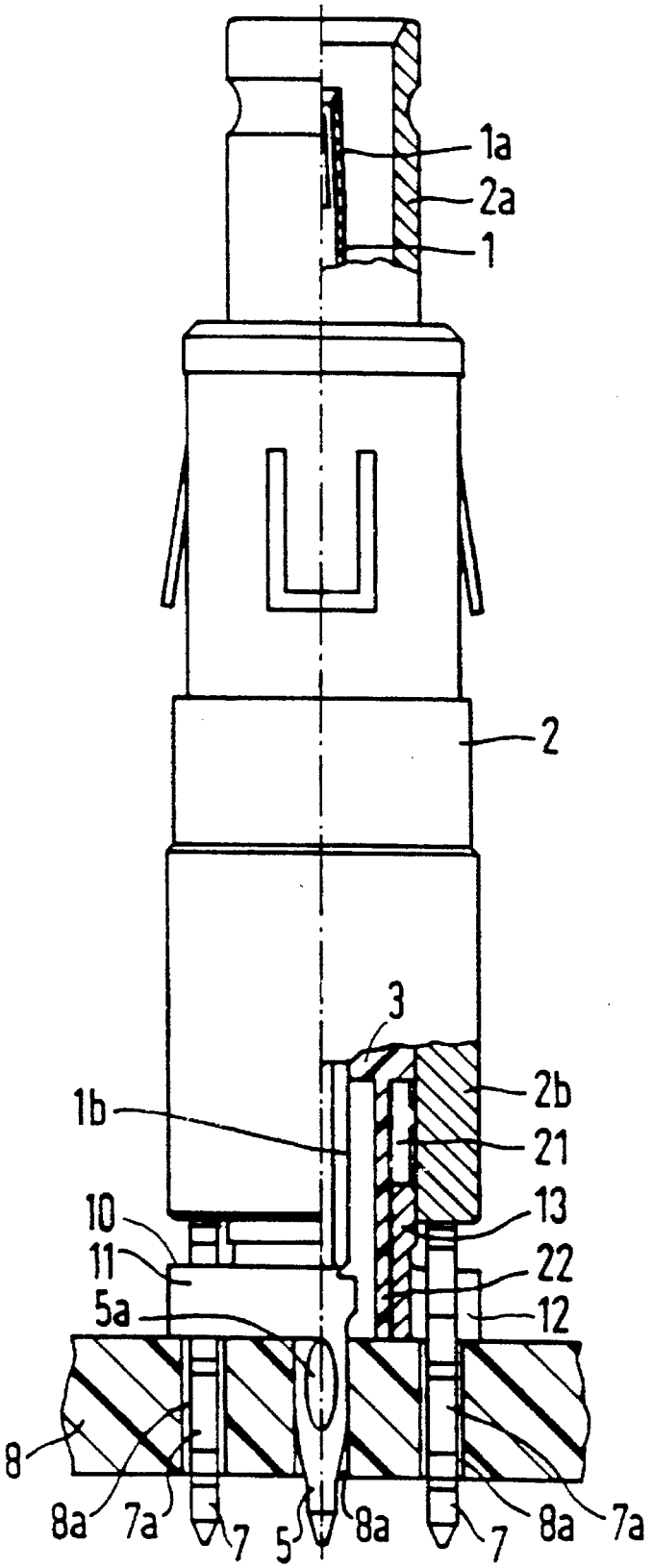
FIG. 1 shows a coaxial plug connector component partially cut, mounted in a printed circuit board
Figure 3:
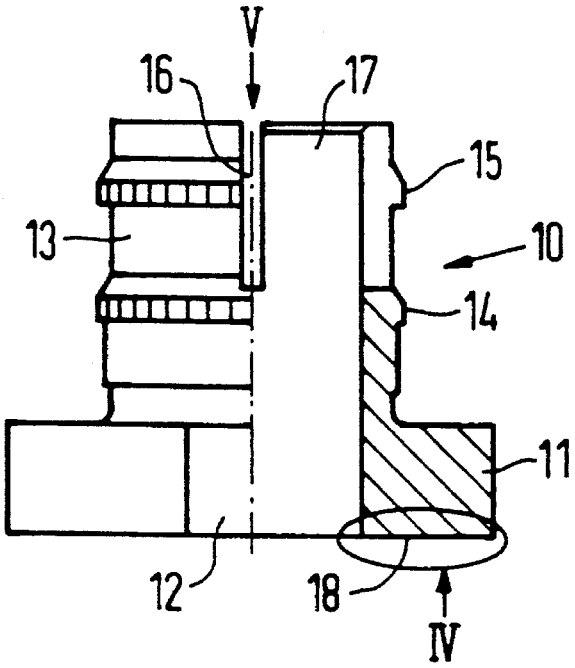
FIG. 3 shows a shielding sleeve from the plug connector of FIG. 1 in side view and partially in section.
Figure 4:
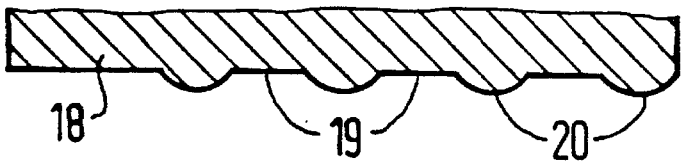
FIG. 4 shows a detail of a region IV from FIG. 3 in an enlarged representation of the end surface of the sleeve and FIG. 5 shows a view in the axial direction of the shielding sleeve in FIG. 3.
Figure 5:
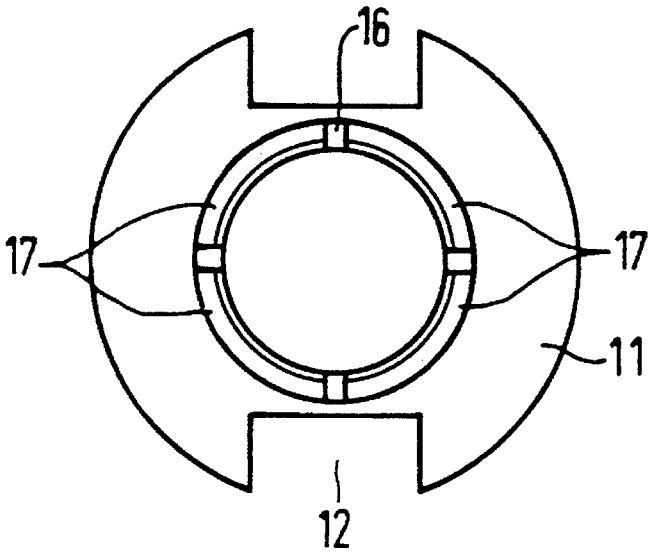

The plug connector component shown in FIGS. 1 and 2 has an inner conductor 1 and an outer conductor 2, the two of which are separated and held coaxially with respect to one another by means of tubular insulation 3. The upper ends 1*a* and 2*a* of the inner conductor 1 and of the outer conductor 2 respectively are used in a known manner for coupling of a complementary plug connector component, which is not described in more detail here. To this extend, the plug connector component shown corresponds to the conventional construction. The lower end 1*b* of the inner conductor 1 has an axial hole (not visible) in which a central conducting pin 5 is anchored. In addition, the hollow-cylindrical outer conductor 2 has two opposite longitudinal holes, which are likewise not shown and in which two peripheral connecting pins 7 are inserted, parallel to the axis. These connecting pins 5 and 7 are each provided with a push-in zone or widening 5*a* or 7*a*, respectively, as a result of which the pins can be attached, and contact can be made without soldering by pushing the pins into contact holes 8*a* in a printed circuit board 8.

In order to make the region between the lower end 2*b* of the outer conductor and the printed circuit board radio-frequency proof, an additional shielding sleeve 10 is provided, which is explained in more detail using FIGS. 2 to 5. This shielding sleeve 10 has a first section 11 of a relatively greater wall thickness and also a greater external diameter. Provided in this section 11 are longitudinal grooves 12 by means of which the shielding sleeve is guided on the peripheral connecting pins 7 with a push fit, but such that it can be moved. In other words, the longitudinal grooves 12 provide clearance for the pins 7 so that the sleeve 10 may move axially relatively thereto.

Furthermore, the shielding sleeve has a second section 13 of a relatively smaller wall thickness which has circumferential ridges 14 and 15 in order to make contact with the outer conductor 2. Towards the free upper end, the second section 13 is additionally divided by slots 16 into a plurality (four in the example) of resilient tabs 17, as a result of which the contact with the outer conductor 2 is improved.

On the lower end of the sleeve 10, that is to say the end 18 facing the printed circuit board 8, the shielding sleeve additionally has concentric annular grooves 19 or annular ridges 20, respectively, by means of which the contact with the printed circuit board is improved and shielding is hence ensured. The structure of this end 18 of the shielding sleeve 10 is shown in an enlarged sectional representation in FIG. 4.

When the plug connector component is inserted into a printed circuit board 8 the connecting pins 5 and 7 are thus pushed into the corresponding holes 8*a*. At the same time, the shielding sleeve 10 comes into contact with the printed circuit board surface. On being pushed in further, the shielding sleeve 10 is pushed back into the lower end 2*b* of the outer conductor 2 in the axial direction, the second section 13 of the shielding sleeve conductor 2 and lower end 22 of the tubular insulation 3, as needed. After being pushed in, the space between the printed circuit board 8 on the one hand and the outer conductor 2 on the other hand is thus completely shielded against radio-frequency radiation.

Although other modifications and changes may be suggested by those skilled in the art, it is the intention of the inventor to embody within the patent warranted hereon all changes and modifications as reasonably and properly come within the scope of his contribution to the art.

I claim:

1. A coaxial plug connector component for connection to a printed circuit board, comprising:

an inner conductor;

a central connecting pin connected to an end of said inner conductor and having a push-in zone:

a hollow cylindrical outer conductor about said inner conductor;

at least two peripheral connecting pins connected to an end of said hollow-cylindrical outer conductor and in each case being provided with a push-in zone for attachment to in each case one hole in printed circuit board, a shielding sleeve held on said at least two peripheral connecting pins between said push-in zones of said at least two peripheral connecting pins and said outer conductor, such that said shielding sleeve is movable in an axial direction, an inwardly pointing edge section of said shielding sleeve overlapping said outer conductor coaxially.

2. A coaxial plug connector component as claimed in claim 1, wherein said shielding sleeve defines longitudinal grooves in its circumference which are parallel to an axis and in which said at least two peripheral connecting pins are guided with a push fit, such that said at least two peripheral connecting pins are movable relative to said shielding sleeve.

3. A coaxial plug connector component as claimed in claim 1, wherein an end surface of said shielding sleeve pointing towards the printed circuit board is provided with coaxial ridges.

4. A coaxial plug connector component as claimed in claim 1, wherein said shielding sleeve has a first section of a greater wall thickness compared to a second section and thereby forming an end contact surface, and said second section of a smaller wall thickness and being in overlapping contact with said hollow cylindrical outer conductor.

5. A coaxial plug connector component as claimed in claim 4, wherein second section of said shielding sleeve is split at least over a part of its axial length into a plurality of resilient tabs in order to make contact with said hollow cylindrical outer conductor.

6. A coaxial plug connector component as claimed in claim 4, wherein said second section of said shielding sleeve projects into an annular cavity between said hollow cylindrical outer conductor and said inner conductor.

7. A coaxial plug connector component as claimed in claim 4, further comprising:

insulator surrounding said inner conductor between said inner conductor and said hollow cylindrical outer conductor;

wherein said second section of said shielding sleeve projects into an annular cavity between said hollow cylindrical outer conductor and said insulation.

* * * * *